United States Patent [19]

Jeschke et al.

[11] 4,387,648

[45] Jun. 14, 1983

[54] INK METERING WITH INDIVIDUAL INK KNIVES RESPECTIVELY EXTENDING OVER THE ENTIRE WIDTH OF THE INKING ZONES

[75] Inventors: Willi Jeschke, Heidelberg; Rudi Junghans, Wilhelmsfeld; Hermann Beisel; Günther Hofmann, both of Walldorf, all of Fed. Rep. of Germany

[73] Assignee: Heidelberger Druckmaschinen AG, Heidelberg, Fed. Rep. of Germany

[21] Appl. No.: 158,785

[22] Filed: Jun. 12, 1980

[30] Foreign Application Priority Data

Jun. 12, 1979 [DE] Fed. Rep. of Germany ..... 2923678

[51] Int. Cl.[3] ..... B41F 31/02

[52] U.S. Cl. ..... 101/365

[58] Field of Search ..... 101/363, 364, 365, 350, 101/210, 208

[56] References Cited

U.S. PATENT DOCUMENTS 3,818,830 6/1974 Schultz ..... 101/350

4,242,598 1/1981 Jeschke ..... 101/365

*Primary Examiner*—Richard J. Apley

*Assistant Examiner*—David J. Isabella

*Attorney, Agent, or Firm*—Herbert L. Lerner; Laurence A. Greenberg

[57] ABSTRACT

Ink duct for offset of letterpress printing machines with an ink metering unit formed of a plurality of zone-wide metering elements disposed closely adjacent one another and adjustable to zonally varying ink-gap thicknesses, and an ink duct roller forming part of the ink duct, including support and metering regions formed on the metering elements, the support regions being constantly in at least indirect contact under spring pressure with the ink duct roller, each of the metering regions of the respective metering elements extending over the entire respective zone width, the respective metering region, as viewed in rotary direction of the ink duct roller, being disposed downstream from and at such a spacing behind the support regions that ink located between the support and metering regions can spread axially and distribute uniformly over the entire zone width, respectively.

10 Claims, 9 Drawing Figures

2
10
8
15
1
5
3
9
14
13
12
24
22
11
23
6
7
4

INK METERING WITH INDIVIDUAL INK KNIVES RESPECTIVELY EXTENDING OVER THE ENTIRE WIDTH OF THE INKING ZONES

The invention relates to an ink duct for offset or letterspress printing machines with an ink metering unit formed of a plurality of zone-wide metering elements disposed closely adjacent one another and adjustable to zonally varying ink gap thicknesses, and having support and metering regions, the support regions being in constant direct or indirect contact with the ink duct roller under spring pressure.

From German Published Prosecuted Application No. 26 48 098, an ink duct of the foregoing type is known wherein each zone-wide metering element has support and metering regions disposed adjacent one another in axial direction of the ink duct roller. This heretofore known device has a number of advantages, permitting, for example, the independent, spring support bracing of each individual metering element on the ink duct roller, as well as independent i.e. not affected by the others, of the ink film thickness of adjacent zones. In addition, variations in the ink film thickness due to the running of the ink duct roller out-of-true are absolutely eliminated. The heretofore known device thus offers the basis for repeated reproducible, sensitive zone-wise determination of the ink gap. Since, however, the support and metering regions are disposed adjacent one another, ink-free strips or stripes on the ink duct roller are unable to be avoided, however.

It is accordingly an object of the invention, while retaining all the advantages of a device according to the foregoing German application to provide such a device wherein the production of ink-free strips or stripes on the duct roller is prevented due to constant contact of the support regions.

With the foregoing and other objects in view, there is provided, in accordance with the invention, an ink duct for offset or letterpress printing machines with an ink metering unit formed of a plurality of zone-wide metering elements disposed closely adjacent one another and adjustable to zonally varying ink-gap thicknesses, and an ink duct roller forming part of the ink duct, comprising support and metering regions formed on the metering elements, the support regions being constantly in at least indirect contact under spring pressure with the ink duct roller, each of the metering regions of the respective metering elements extending over the entire respective zone width, the respective metering region, as viewed in rotary direction of the ink duct roller, being disposed downstream from and at such a spacing behind the support regions that ink located between the support and metering regions can spread axially and distribute uniformly over the entire zone width, respectively. The ink-free stripes produced by the support regions can thereby again be filled with ink. No additional ink distribution is thus required to eliminate the damaging effects exerted by the ink-free strips possibly upon the inking of the printing plate.

In accordance with another feature of the invention the metering elements have a cylindrical surface and are turnable in direction of the cylindrical surface thereof, and there is provided a foil interposed between at least one of the support regions constantly forced by the spring pressure into at least indirect contact with the ink duct roller, means defining flow-through grooves formed on the metering elements adjacent the support regions, as viewed in longitudinal direction of the metering elements, metering knives disposed on the metering elements and offset in peripheral direction from the support regions, the metering knives projecting beyond the periphery of the metering elements at least up to the plane of the support region and extending over the entire length of the respective metering element.

In accordance with a further feature of the invention the metering elements are of flat-piece construction and are displaceable tangentially to the ink duct roller, the metering elements having rib-shaped support regions extending in direction of tangential displacement thereof, means defining flow-through grooves between the support regions, the support regions being braced through the intermediary of a foil against the ink duct roller, and a zone-wide metering knife fastened to a front end of each of the metering elements, the metering knive having a stripping edge projecting slightly beyond the support regions.

In accordance with an additional feature of the invention each of the metering elements is formed of at least two parts, one of the parts of the metering elements having the support regions, the other part of the metering element having the metering region extending over the entire respective zone width and being adjustably mounted in the one part of the metering elements having the support regions.

In accordance with an added feature of the invention, there are provided zone-wide pressure pads disposed closely adjacent one another in the ink duct over the entire length of the ink duct roller, the pressure pads being spring-biased and being braced, through the support regions, against the ink duct roller, means defining flow-through grooves disposed in the pressure pads between the support regions and extending in rotary direction of the ink duct roller, and a zone-wide rotary valve mounted in each of the pressure pads downstream of the support regions as viewed in rotary direction of the ink duct roller, the rotary valve being coaxial to the ink duct roller and being mounted for rotation about the longitudinal axis thereof.

In accordance with yet another feature of the invention, the rotary valve is eccentric over part of the periphery thereof.

In accordance with yet a further feature of the invention, the metering elements are zone-wide blades displaceable tangentially to the ink duct roller and having a stripping edge at a front thereof, and there is provided at least one support arm on each of the metering elements, and at least one rotatable support roller carried by the support arm, the support roller being disposed in front of the stripping edge, the respective metering element being braced thereby against the ink duct roller.

In accordance with yet an additional feature of the invention, the respective metering element is directly braced by the at least one support arm through the intermediary of a foil against the ink duct roller.

In accordance with yet an added feature of the invention, the means defining the flow through grooves are flattened portions of the metering elements.

In accordance with a concomitant feature of the invention, the means defining the flow-through grooves are curved portions of the metering elements.

Other features which are considered as characteristic for the invention are set forth in the appended claims.

Although the invention is illustrated and described herein as embodied in an ink metering with individual ink knives respectively extending over the entire width of the inking zones, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
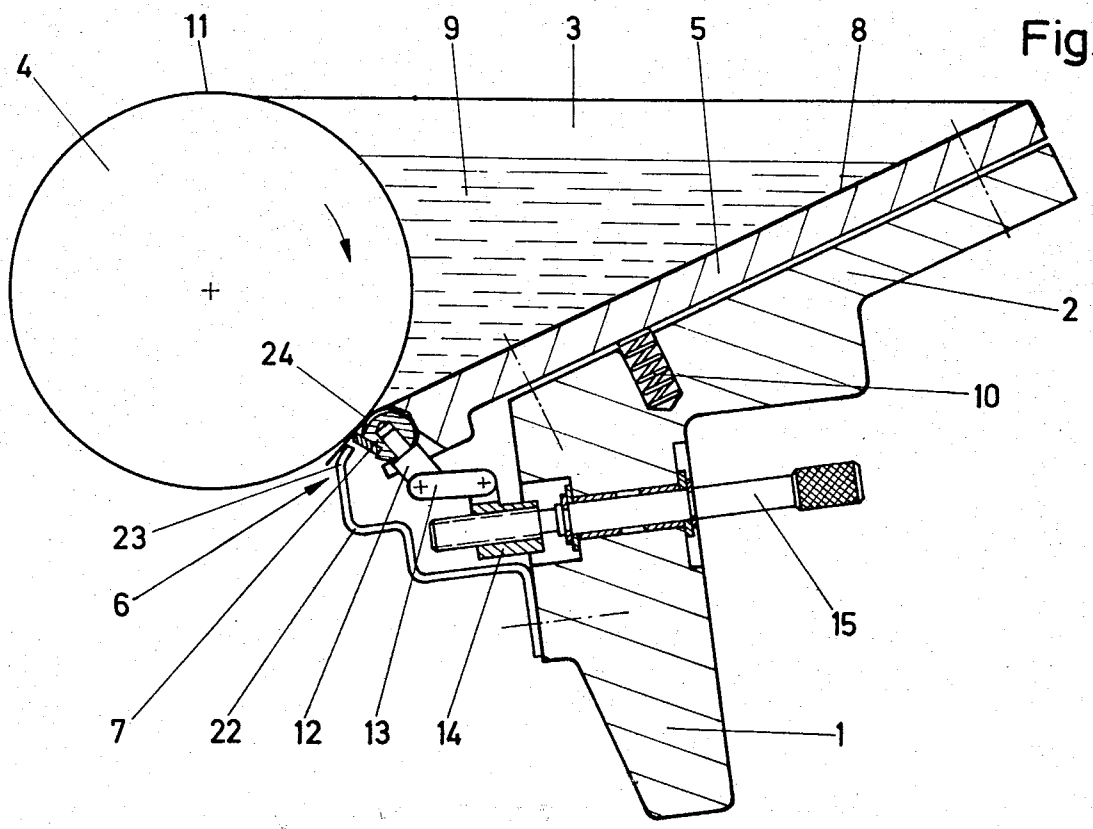
FIG. 1 is a cross sectional view of an ink duct with metering elements according to the invention.

Referring now to the drawing and first, particularly, to FIG. 1 thereof, there is shown an ink duct or fountain 1 formed basically of a base plate 2 and side walls 3 wherein an ink duct roller 4 is mounted. Pressure pads or strips 5 are provided adjacent one another above the base plate 2 and are releasably connected to the ink duct 1 by non-illustrated screws represented by respective dot-dash lines. An ink metering unit 6 is located at the lower end of the pressure pads 5. The ink metering unit 6 is formed basically of metering elements 7 which are disposed closely adjacent to one another and axially parallel to the duct roller 4. The pressure pads 5 and the metering elements 7 are covered by an elastic foil 8 which is fastened to the pressure pads 5 in the upper region of the ink duct 1. Printing ink 9 is provided in the wedge-shaped space between the elastic sheet 8, the side walls 3 of the ink duct 1, and the duct roller 4. Each zone-wide pressure pad 5 is supported or braced on a compression spring 10 provided in the base plate 2 of the ink duct 1. The hereinaforementioned screws give each pressure pad 5 so much freedom of movement in the vertical direction that the metering elements 7 are constantly pressed against the cylindrical surface 11 of the duct roller 4 under the intermediary of the elastic sheet 8.

Figure 2:
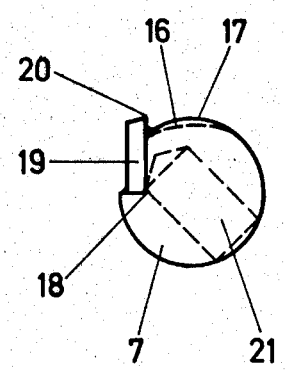
FIG. 2 is an enlarged fragmentary side elevational view of FIG. 1 showing a metering element with a metering knife.
Figure 3:
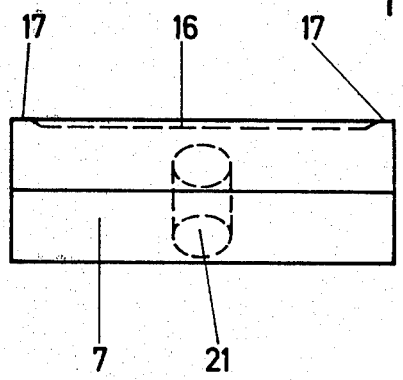
FIG. 3 is a front elevation of FIG. 2 showing the metering element with the metering knife omitted.

Each metering element 7 is adjustable about the longitudinal axis thereof by an adjusting arm 12, a guide bar or control lever 13, an adjusting nut 14 and a zone adjusting or set screw 15 which is turnably mounted in the ink duct 1. The range of adjustment encompasses a O-position in which no ink is let through in the respective zone, which is the position shown in FIG. 1, and all remaining settings up to maximum ink film thickness. The metering element 7, as shown particularly in FIGS. 2 and 3, is of cylindrical construction, yet has at the circumference or periphery thereof a flattened or eccentrically turned part forming a so-called flow-through groove 16. This flow-through groove 16, however, does not extend over the entire length of the metering element 7, but rather, leaves an annular shoulder at both ends thereof, namely, so-called support regions 17. Provided in the cylindrical metering element 7 and offset from the flow-through groove 16 and thus also from the support regions 17, is a secantal recess 18 in which there is provided a metering knife 19 extending over the entire length of the metering element. The metering knife 19 has a stripping edge 20 which represents the metering region and rises at least up to a level with that part of the support regions 17 which rises the highest above the flow-through groove 16. The metering element 7 is also formed with a base 21 into which the adjusting arm 12 projects.

As can be seen from FIG. 1, the elastic sheet 8 covers not only all the pressure pads 5, but, as mentioned hereinbefore, also the metering elements 7 to above and beyond the stripping edge 20 of the metering knives 19. In order to protect the entire ink metering unit 6, the ink duct 1 is provided with a cover plate 22. The upper free end 23 thereof, as viewed in FIG. 1, is angled toward the metering elements 7 and is covered also by the elastic foil 8.

By actuating the zone adjusting screw 15, the metering element 7 associated therewith is adjusted about the longitudinal axis thereof in such a way that the gap between the stripping edge 20 of the zone-wide metering knife 19 and the jacket surface 11 of the ink duct roller 4 is varied. The elastic foil or sheet 8 adapts to the setting of the metering knife 19 i.e. as a result of the hydro-dynamic pressure of the ink 9, the foil 8 rests constantly on the stripping edge 20 of the metering knife 19. In this way, the setting or position of the metering knife 19 determines the ink stripe thickness of this zone.

The metering knife 19 is removed by such a distance from the contact point 24 of the support regions 17 that the intermediate space is large enough to deflect the elastic sheet, due to dynamic pressure, so that the ink 9 flows in axial direction into the region wherein the support regions 17, due to the constant contact thereof, produce an ink-free stripe on the surface 11 of the ink duct roller 4. Despite the constant indirect contact of the support region 17 on the ink duct roller 4, a zone-wide, continuous ink film thickness is thus produced due to the offset arrangement of the zone-wide metering knives 19.

Figure 4:
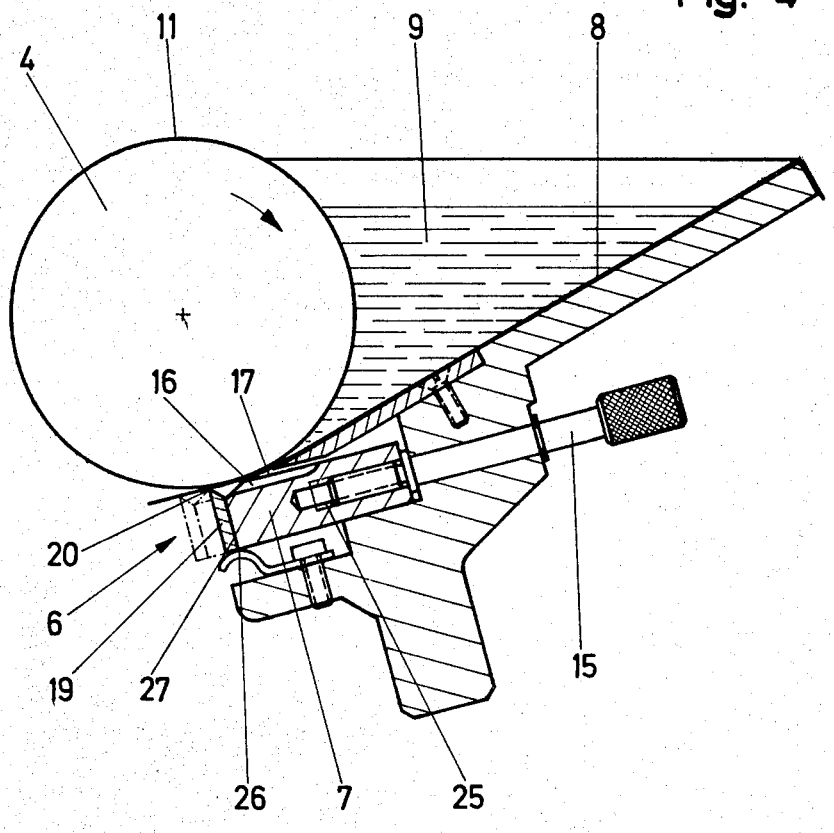
FIG. 4 is a cross-sectional view of another embodiment of the ink duct with metering elements constructed as flat pieces.
Figure 5:
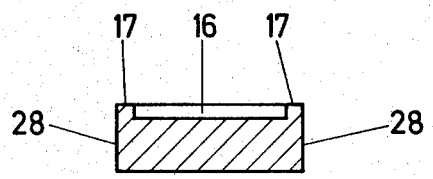
FIG. 5 is a fragmentary sectional view of FIG. 4 showing the metering element formed as a flat piece.

The embodiment of the invention shown in FIG. 4 differs from the one previously described principally only in that the metering elements 7 of the ink metering unit 6 have been given a flat piece construction. FIG. 5 is a cross-sectional view of such a flat-piece metering element. The metering elements 7 are, thus, in this case, used as slides or sliders.

The zone adjusting or set screw 15 projects into a threaded bore 25 formed in the metering element 7 and, when turned, causes a tangential displacement or shifting of the metering element 7 relative to the ink duct roller 4. A leaf spring 26 mounted in the ink duct 1 constantly presses the associated metering element 7 in direction toward the ink duct roller 4. The metering element 7 is braced or supported on the surface 11 of the ink duct roller by rib-shaped support regions 17 through the intermediary of the elastic sheet 8. Between the support regions 17 provided on the longitudinal sides 28 of the metering element 7 is a flow-through groove 16, the size of which is exaggerated in FIG. 5. The groove 16 needs only to have such a depth that sufficient ink can flow through for the maximum zonal ink film thickness.

Fastened to the front end face 27 of each metering element 7 of flat-piece combination is a zone-wide metering knife 19. The stripping edge 20 thereof projects beyond the support regions 17. The height of the stripping edge 20 must be such that, in the O-position of the metering element 7, the stripping edge 20 and the support areas 17 are both simultaneously in contact with the cylindrical surface 11 of the ink duct roller 4. In this embodiment, too, all the metering elements 7 are covered by the elastic foil 8 to above the metering knives 19. The stripping edge 20 and the support regions 17 are thus never in direct contact with the surface 11.

By misplacing the metering elements 7 tangentially to the ink duct roller 4, the gap between the stripping edge 20 (including the overlying foil 8) and the surface 11 of the ink duct roller 4 in the respective zone is varied. This correspondingly varies the zonal ink film thickness. Although the support regions 17 contact the surface 11 of the ink duct roller 4 indirectly, the ink-free stripes produced thereby cannot have any detrimental effect because, in the space between the support regions 17 and the stripping edge 20, the ink 9 which is under dynamic pressure fills up the ink-free region produced by the support regions 17.

Figure 6:
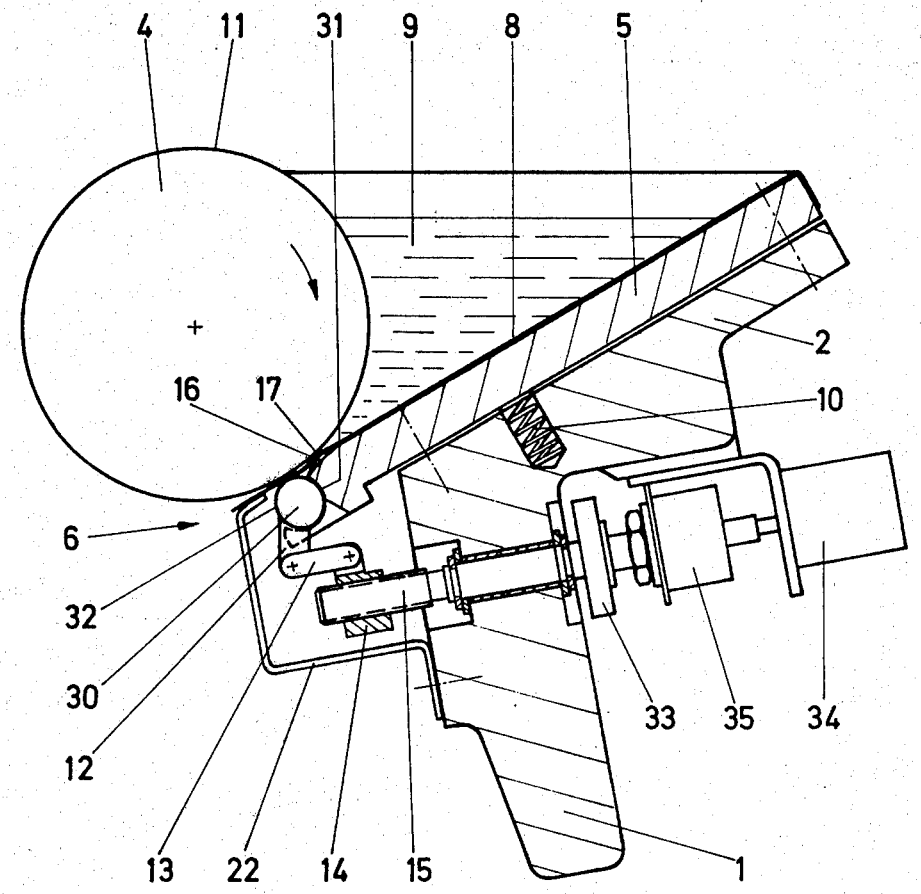
FIG. 6 is a cross-sectional view of a third embodiment of the ink duct with bipartite metering elements.

The embodiment of the ink duct 1 shown in FIG. 6 with an ink metering unit 6 according to the invention has bipartite metering elements 7, that is, namely on the base plate 2 of the ink duct 1, just as in the embodiment shown in FIG. 1, zone-wide pressure-pads 5 biased by the pressure of a spring 10, are provided. At the front end thereof, however, these pressure pads 5 have support regions 17 by which they rest on the surface 11 of the ink duct roller 4 with the sheet 8 disposed therebetween.

Mounted in the front-most region of this spring pressure pad 5 is a cylindrical rotary valve 30 which can be rotated about the longitudinal axis thereof. The rotary valve 30, moreover, extends coaxially to the ink duct roller 4 and is formed of a cylinder which has precisely the length of the zone width and is eccentrically machined over a given peripheral region thereof. In the concentric region thereof it is mounted in a plain or sliding bearing 31 of the pressure pad 5. The eccentrically turned region 32 can be placed opposite the ink duct roller 4 by suitable adjusting means. The eccentricity of this machined area causes a varying gap to be formed over the entire zone width, the size of the gap depending upon the setting between the elastic foil 8, which covers the pressure pad 5 and the rotary valve 30, and the surface 11 of the ink duct roller 4. Instead of the eccentrically turned or machined region, it would also be possible to use a flattened region as the metering area surface. The support regions 17 which, as mentioned hereinbefore, are disposed directly on the pressure pads 5, have a rib-shaped construction, similar to the flat-piece, slide-type metering element 7 shown in FIG. 5. Between the support regions 17, a flow-through groove 16 extending in direction of rotation of the ink duct roller 4 is provided and is of such dimensions that sufficient ink 9 can flow through even for the maximum inking gap setting.

Each zone-wide rotary valve 30 is turnable about the longitudinal axis thereof by the adjusting arm 12, the guide bar 13, the adjusting nut 14 and the zone adjusting screw 15.

The zone adjusting screw 15 is actuatable not only by means of the handwheel 33 but, for remote adjustment, also by a servemotor 34. The respective position of the zone adjusting screw 15, and thus the angular position of the rotary valve 30, is reported or signalled by a potentiometer 35 actuated by the zone adjusting screw 15. The potentiometer 35 forms part of a conventional indicating or regulating device.

Figure 7:
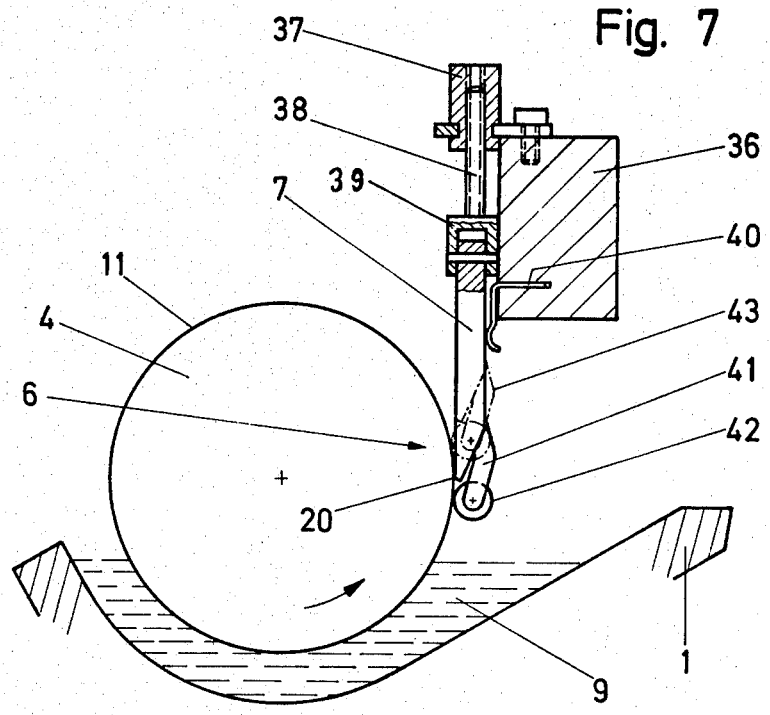
FIG. 7 is a fragmentary cross-sectional view of a fourth embodiment of the ink duct with zone-wide blade-shaped metering device.
Figure 8:
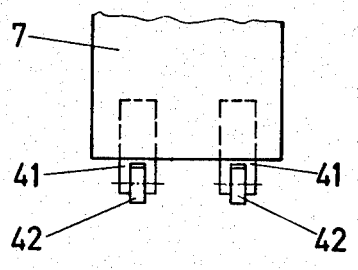
FIG. 8 is a fragmentary diagrammatic front elevational view of one of the blade-shaped metering elements of FIG. 7 having two support rollers.

FIG. 7 shows an ink duct 1 with the ink duct roller 4 immersed in the ink 9, and an ink metering unit 6 provided above the ink duct 1. The ink metering unit 6 is formed of a series of metering elements 7, arranged over the length of the ink duct and constructed as zone-wide meter blades. Adjusting nuts 37 for each zone are rotatably mounted in a cross-beam or traverse 36 extending parallel to the ink duct roller 4. Projecting into each adjusting nut 37 is a threaded pin 38, the free end of which is connected to a slide claw 39 in which the blade-shaped metering element 7 is fastened. A leaf spring 40 provided in the cross-beam 36 is in contact with the underside of the blade-shaped metering element 7 and forces the latter in direction toward the cylindrical surface 11 of the ink duct roller 4. The front end of the metering element 7 is provided with the stripping edge 20 and also has on its end face thereof, as can be seen especially in FIG. 8, two support arms 41 on which support rollers 42 are rotatably mounted. These support rollers 42 engage and run on the cylindrical surface 11 of the ink duct roller 4.

The respective position of the blade-shaped metering element 7 in the vertical direction determines the spacing of the stripping edge 20 from the cylindrical surface 11 of the ink duct roller 4. In the lower position shown in solid lines the stripping edge 20 is in contact with the surface 11 and does not, therefore, allow any ink to pass.

If, However, the blade-shaped metering element 7 is moved vertically upwards by means of the adjusting nut 37, for example, into the position 43, shown in phantom, then the support rollers 41 continue to remain in contact with the surface 11 of the ink duct roller 4, since the leaf spring 40 forces the metering element 7 in direction toward the ink duct roller 4. However, between the stripping edge 20 and the cylindrical surface 11, there is a considerable gap with the result that a corresponding zonal ink film forms. Since, as viewed in direction of rotation of the ink duct roller 4, the support rollers 42 are positioned ahead or forward of the stripping edge 20, the ink-free stripes produced thereby can be filled up with ink again by the stripping edge 20.

Since the metering elements 7 are located outside the ink duct 1, and above the level of the ink 9, they do not have to be covered by a foil 8. All zone-wide metering elements 7 are disposed adjacent and directly engaging one another. This assures a completely independent, stripe-free setting or adjustment of the ink film in each zone.

Figure 9:
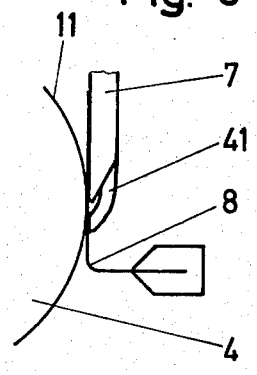
FIG. 9 is a fragmentary diagrammatic side elevational view of a zone-wide balde-shaped metering element having support arms with the intermediary of a foil.

In order to increase the service life of the blade-shaped metering elements 7, it is possible, as shown in FIG. 9, to cover the metering elements 7 with an elastic foil 8 even in the case of an embodiment such as that according to FIG. 7. In such a case, each zone-wide blade-shaped metering element 7 can be braced directly by the support arms 41 on the cylindrical surface 11 of the ink duct roller 4. The support rollers 42 can then be dispensed with.

The invention, as mentioned hereinbefore, is not restricted to the illustrated embodiments. As a rule, each metering element 7 is in independent spring contact with the ink duct roller 4 i.e. independent of the others. However, it is also possible to join several pressure pads 5 together and to bring them into joint contact with the ink duct roller 4 by means of a spring element. Furthermore, experience has shown that a gap of approximately 4 mm is to be provided between the contact point 24 and the stripping edge 20 in order to ensure adequate filling-up of the ink-free stripes. However, it is quite conceivable that this gap can be reduced by means of a special construction of the support regions 17. Another possible variation of the construction of the invention is to replace the rotary valve 30 in the embodiment shown in FIG. 6 by other valve constructions.

There are claimed:

1. Ink duct for offset or letterpress printing machines with an ink metering unit formed of a plurality of zone-wide metering elements disposed closely adjacent one another and adjustable to zonally varying ink-gap thicknesses, and an ink duct roller forming part of the ink duct, comprising means for providing a support and means for metering formed on the metering elements, said support means being constantly in at least indirect contact under spring pressure with the ink duct roller, said support means also being formed with an ink flow-through passage of a size affording adequate flow of ink therethrough even for an adjusted maximum ink-gap thickness, each of the metering means of the respective metering elements extending over the entire respective zone width, the respective metering means being connected to said support means and, as viewed in rotary direction of the ink duct roller, being disposed downstream from said ink flowthrough passage and at such a spacing behind said support means that ink located between said support means and said metering means can spread axially and distribute uniformly over the entire zone width, respectively.

2. Ink duct according to claim 1 wherein the metering elements have a cylindrical surface and are turnable about a longitudinal axis in direction of said cylindrical surface thereof, and including a foil interposed between at least one of said support means and the ink duct roller and constantly forced by the spring pressure into at least indirect contact with the ink duct roller, means for defining flow-through grooves formed on the metering elements adjacent said support means, as viewed in longitudinal direction of the metering elements, said metering means comprising metering knives disposed on the metering elements and offset in peripheral direction from said support regions, said metering knives projecting beyond the periphery of the metering elements at least up to the plane of the support means and extending over the entire length of the respective metering element.

3. Ink duct according to claim 1 wherein the metering elements are of flat-piece construction and are displaceable tangentially to the ink duct roller, the metering elements having rib-shaped support means extending in direction of tangential displacement thereof, means defining flow-through grooves between said support means, said support means being braced through the intermediary of a foil against the ink duct roller, and a zone-wide metering knife fastened to a front end of each of the metering elements, said metering knife having a stripping edge projecting slightly beyond said support means.

4. Ink duct according to claim 1 wherein each of the metering elements is formed of at least two parts, one of the parts of the metering elements having said support means, the other part of the metering element having said metering means extending over the entire respective zone width and being adjustably mounted in the one part of the metering elements having said support means.

5. Ink duct according to claim 4 including zone-wide pressure pads disposed closely adjacent one another in the ink duct over the entire length of the ink duct roller, said pressure pads being spring-biased and being braced, through said support means, against the ink duct roller, means defining flow-through grooves disposed in said pressure pads between said support means and extending in rotary direction of the ink duct roller, and a zone-wide rotary valve mounted in each of said pressure pads downstream of said support means as viewed in rotary direction of the ink duct roller, said rotary valve being coaxial to the ink duct roller and being mounted for rotation about the longitudinal axis thereof.

6. Ink duct according to claim 5 wherein said rotary valve is eccentric over part of the periphery thereof.

7. Ink duct according to claim 1 wherein the metering elements are zone-wide blades displaceable tangentially to the ink duct roller and having a stripping edge at a front region thereof, and including at least one support arm on each of the metering elements, and at least one rotatable support roller carried by said support arm, said support roller being disposed in front of said stripping edge, the respective metering element being braced thereby against the ink duct roller.

8. Ink duct according to claim 7 wherein the respective metering element is directly braced by said at least one support arm through the intermediary of a foil against the ink duct roller.

9. Ink duct according to claim 2 wherein said means defining said flow through grooves are flattened portions of the metering elements.

10. Ink duct according to claim 2 wherein said means defining said flow-through grooves are curved portions of the metering elements.

* * * * *